US006614912B1

(12) United States Patent
Yamada et al.

(10) Patent No.: US 6,614,912 B1
(45) Date of Patent: Sep. 2, 2003

(54) SOUND REPRODUCING DEVICE, EARPHONE DEVICE AND SIGNAL PROCESSING DEVICE THEREFOR

(75) Inventors: Yuji Yamada, Tokyo (JP); Yasuhisa Ikeda, Chiba (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/232,634

(22) Filed: Jan. 19, 1999

(30) Foreign Application Priority Data

Jan. 22, 1998 (JP) ..... P10-010239
May 22, 1998 (JP) ..... P10-140972

(51) Int. Cl.[7] ..... H04R 5/02
(52) U.S. Cl. ..... 381/310; 381/74
(58) Field of Search ..... 381/303, 309, 381/310, 74, 1

(56) References Cited

U.S. PATENT DOCUMENTS 5,181,248 A * 1/1993 Inanaga et al. ..... 381/74

* cited by examiner

*Primary Examiner*—Minsun Oh Harvey
(74) *Attorney, Agent, or Firm*—Jay H. Maioli

(57) ABSTRACT

A sound reproducing device including a signal processing device including a first signal processing circuit supplied with an input audio signal of at least one channel to convert the input audio signal to a 2-channel audio signal with which an acoustic image is located at a predetermined position when the input audio signal is reproduced substantially by a 2-channel speaker system, and a second signal processing circuit supplied with the 2-channel audio signal to subject the 2-channel audio signal to signal processing which is equivalent to a transfer function of the 2-channel speaker system to both the ears of a listener, thereby converting and outputting the input audio signal to a 2-channel audio signal. Also included is an earphone device including a pair of electro-acoustic transducers supplied with the 2-channel audio signal from the second signal processing circuit, and a detector for detecting movement of the head of the listener, wherein the second signal processing circuit performs the processing corresponding to an alteration of the transfer function in accordance with the output of the detector to control the location position of the acoustic image which is perceived by the listener.

10 Claims, 10 Drawing Sheets

SOUND REPRODUCING DEVICE, EARPHONE DEVICE AND SIGNAL PROCESSING DEVICE THEREFOR

BACKGROUND OF THE INVENTION

The present invention relates to a sound reproducing device, an earphone device and signal processing device therefor with which multi-channel audio signals are reproduced.

Audio signals which are annexed to pictures such as movies or the like are multi-channeled and recorded on the assumption that these signals are reproduced from speakers located at both the left and right sides of a screen and speakers located at both the left and right rear sides of a listener or both the left and right sides of the listener, whereby the position of a sound source in pictures is made coincident with the position of an acoustic image which is actually heard by a listener and thus a sound field having more natural breadth is established.

However, when such audio signals are appreciated with a headphone, an earphone or the like, the acoustic image is fixedly located (positioned) in the head of the listener, and the direction (position) of the sound source in the pictures is not coincident with the locating position of the acoustic image thereof, so that the location (orientation) of the acoustic image is extremely unnatural.

This also occurs in such a case that a listener appreciates a music piece not accompanied by a picture. That is, unlike the case of the reproduction using speakers, the sound is heard from the inside of the head, and this also results in reproduction of an unnatural sound field.

Therefore, there has been considered a method of beforehand measuring or calculating a head transfer function (impulse response) from a speaker located in front of a listener to both the ears of the listener, convoluting the head transfer function thus measured (calculated) into an audio signal with a digital filter and then supplying the audio signal thus obtained to the headphone or the like. According to this method, the acoustic image is located at the outside of the head, and a sound field near to that obtained the speaker reproduction system can be achieved.

This method enables the acoustic image to be located outside of the head. However, when the listener changes his/her head position, the locating position of the acoustic image is also displaced together with the movement of the head. Therefore, when the audio signals accompany pictures, there occurs a displacement between the direction of the sound source in the pictures and the direction of the acoustic image, and thus the location of the acoustic image is unnatural.

In order to overcome such a disadvantage, there has been considered a method of detecting the movement of the head of a listener and renewing the coefficient of a digital filter in accordance with the movement of the head to fix the location of the acoustic image with respect to a listening environment. According to this method, the acoustic image is not fixedly located (positionally fixed) in the head, and also the acoustic image is not displaced even when the head is moved. Therefore, the substantially same acoustic image as achieved by speakers can be obtained.

In such a case that two persons appreciate a movie reproduced by a DVD player or the like, the motions of the heads of the two persons are not necessarily coincident with each other. Therefore, when the same sound field as achieved by the speaker reproduction system is required to be implemented by the above reproducing circuit, two sets of reproducing circuits must be prepared for the two persons, and the coefficient of the digital filter must be individually controlled in each of the reproducing circuit.

However, when the coefficient of the digital filter is renewed in accordance with the movement of the head, the coefficient of the digital filter must be renewed immediately every time the head is moved irrespective of a slight movement of the head. Accordingly, a large number of high-speed sum-of-products operating circuits and memories are needed. If the reproduction circuits whose number is equal to the number of audience are required, the price of the system would be extremely high.

On the other hand, when a music piece not accompanied by a picture is appreciated, if the acoustic image is located out of the head, there is little problem even when the acoustic image is moved together with the head of the listener. However, a headphone cord connecting an audio device and a headphone gets in the way.

SUMMARY OF THE INVENTION

The present invention has been implemented in view of the above situation, and has an object to provide a sound reproducing device, an earphone device and a signal processing device with which the same reproduction sound field as achieved by a speaker reproduction system (in which multi-channel audio signals are supplied to the corresponding speakers to reproduce sounds) can be achieved, and also even when a listener moves his/her head at that time, the locating position of the acoustic image can be fixed with respect to a listening environment.

In order to attain the above object, according to a first aspect of the present invention, a sound reproducing device comprises: a signal processing device including a first signal processing circuit supplied with an input audio signal of at least one channel to convert the input audio signal to a 2-channel audio signal with which an acoustic image is located at a predetermined position when the input audio signal is reproduced substantially by a 2-channel speaker device, and a second signal processing circuit supplied with the 2-channel audio signal to subject the 2-channel audio signal to signal processing which is equivalent to a transfer function from the 2-channel speaker device to both the ears of a listener, thereby converting and outputting the input audio signal to a 2-channel audio signal; and at least one earphone device including a pair of electro-acoustic transducing means supplied with the 2-channel audio signal from the second signal processing circuit, and detection means for detecting the movement of the head of the listener, wherein the second signal processing circuit performs the processing corresponding to an alteration of the transfer function in accordance with the output of the detection means to control the location position of the acoustic image which is perceived by the listener.

According to a second aspect of the present invention, a sound reproducing device comprises: a signal processing device including a first signal processing circuit supplied with an input audio signal of at least one channel to convert the input audio signal to a 2-channel audio signal with which an acoustic image is located at a predetermined position when the input audio signal is reproduced substantially by a 2-channel speaker device, and a second signal processing circuit supplied with the 2-channel audio signal to subject the 2-channel audio signal to signal processing which is equivalent to a transfer function from the 2-channel speaker device to both the ears of a listener, thereby converting and outputting the input audio signal to a 2-channel audio signal; and an earphone device including a third signal processing circuit supplied with 2-channel audio signals from the second signal processing circuit, a pair of electro-acoustic transducing means supplied with the output signal from the third signal processing circuit, and detection means for detecting the movement of the head of the listener, wherein the third signal processing circuit performs the processing corresponding to an alteration of the transfer function in accordance with the output of the detection means to control the location position of the acoustic image which is perceived by the listener.

According to a third aspect of the present invention, an earphone device used in combination with a signal processing device which is supplied with an input audio signal of at least one channel to convert the input audio signal to a 2-channel audio signal with which an acoustic image is located at a predetermined position when the input audio signal is reproduced substantially by a 2-channel speaker device, subjects the 2-channel audio signal to signal processing equivalent to a transfer function from the 2-channel speaker device to both the ears of a listener, thereby converting and outputting the input audio signal to a 2-channel audio signal, comprises: a signal processing circuit supplied with the 2-channel audio signals from the signal processing circuit; a pair of electro-acoustic transducing means supplied with the output signal from the signal processing circuit; and detection means for detecting the movement of the head of the listener, wherein the signal processing circuit performs the processing corresponding to an alteration of the transfer function on the 2-channel audio signals in accordance with the output of the detection means to control the location position of the acoustic image which is perceived by the listener.

According to a fourth aspect of the present invention, a signal processing device for transmitting 2-channel audio signals to an earphone device having a pair of electro-acoustic transducing means under a wireless condition, includes: a first signal processing circuit which is supplied with an input audio signal of at least one channel to convert the input audio signal to 2-channel audio signals with which an acoustic image is located at a predetermined position when the input audio signal is reproduced substantially by a 2-channel speaker device; a second signal processing circuit which is supplied with the 2-channel audio signal output from the first signal processing circuit and subjects the 2-channel audio signals to the signal processing equivalent to a transfer function from the 2-channel speaker device to both the ears of a listener to convert and output the input audio signals to 2-channel audio signals; and transmission means for transmitting the 2-channel audio signals output from the second signal processing circuit under the wireless condition.

DETAILED DESCRIPTION OF THE PREFERRED EMBODIMENT

Preferred embodiments according to the present invention will be described hereunder with reference to the accompanying drawings.

Figure 1:
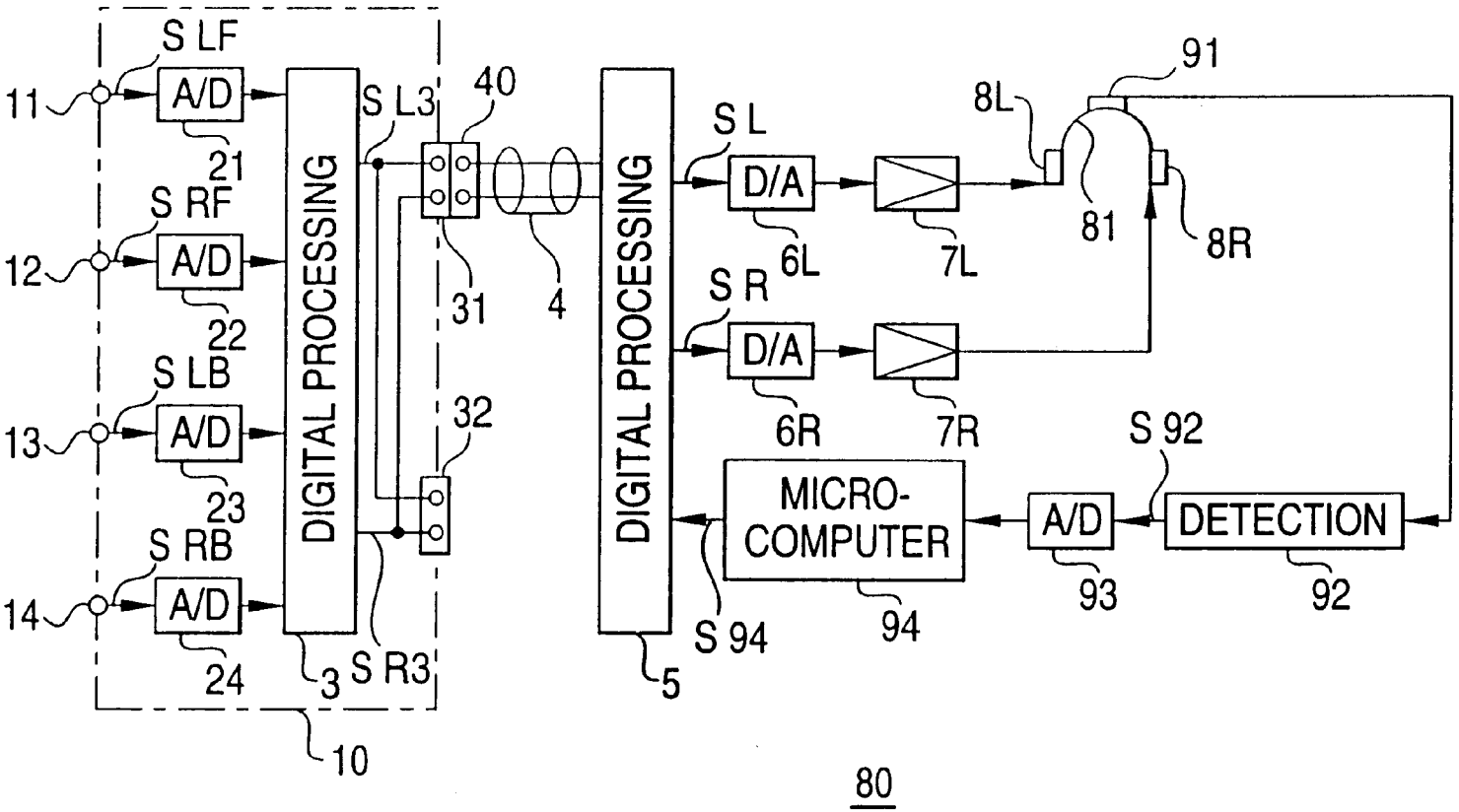
FIG. 1 is a systematic diagram showing an embodiment of the present invention.

FIG. 1 shows an embodiment of a sound reproducing device according to the present invention.

The sound reproducing device of this embodiment comprises a headphone adapter 10, and a headphone 80 which is supplied with the output signal of the headphone adapter 10. Reference characters SLF, SRF, SLB, SRB represents 4-channel audio signals. When these signals SLF, SRF, SLB, SRB are respectively supplied to speakers located at the left front side, the right front side, the left rear side and the right rear side respectively, the reproduction sound field of 4-channel stereo is implemented.

In the headphone adapter 10, the audio signals SLF to SRB are supplied to A/D converter circuits 21 to 24 through input terminals 11 to 14 to be subjected to A/D conversion, and the audio signals SLF to SRB after the A/D conversion are supplied to a digital processing circuit 3 constructed by DSP, for example. The details of the digital processing circuit 3 will be described later, and it serves to convert the audio signals SLF to SRB (4-channel signals) to audio signals SL3, SR3 (2-channel signals) with which the location of a 4-channel stereo sound field can be achieved through two speakers.

That is, the digital processing circuit 3 aims to convert the signals SLF to SRB to the signals SL3, SR3 so that a reproduction sound field having the same level as achieved when the signals SLF, SRF, SLB, SRB are supplied to the speakers located at the left front side, the right front side, the left rear side and the right rear side of a listener is implemented when the signals SL3, SR3 are supplied to the speakers located at the left front side and the right front side of the listener respectively (at this time point, the audio signals SLF to SRB, SL3, SR3 are digital signals, however, the description will be made on the assumption that they are analog signals in order to simplify the description).

The audio signals SL3, SR3 are output to two output connectors 31, 32, for example.

For example, the connector 31 is connected to the connector 40, and the signals SL3, SR3 output to the connector 31 are output from the connector 40 through a cable 4 to the digital processing circuit 5. The details of the digital processing circuit 5 will be also described later. It is constructed by DSP, for example, and it serves to convert the audio signals SL3, SR3 to audio signals SL, SR with which the location of the acoustic image is achieved out of the head when these signals are heard by a headphone.

That is, the digital processing circuit 4 serves to convert the signals SL3, SR3 to the signals SL, SR so that when the signals SL, SR are supplied to the headphone, the same-level reproduction sound field as achieved when the signals SL3, SR3 are supplied to the speakers located at the left front side and the right front side of the listener is implemented.

The audio signals SL, SR are supplied to D/A converter circuits 6L, 6R to be subjected to D/A conversion, and the audio signals SL, SR after the D/A conversion are supplied to left and right acoustic units (electric/acoustic conversion elements) 8L, 8R of the headphone 80 through headphone amplifiers 7L, 7R. The acoustic units 8L, 8R are linked to each other through a band 81 so that the acoustic units 8L, 8R are held at the left and right ear positions of the listener when the headphone 80 is put on the head.

In addition, a rotational angular speed sensor 91 is provided to the band 81 of the headphone 80 for example, and the output signal thereof is supplied to a detection circuit 92 to detect the angular speed of the head of the listener when the listener rotates his/her head. The detection signal is supplied to an A/D converter circuit 93 and A/D-converted to a digital detection signal S92, and then the detection signal S92 after the A/D conversion is supplied to a microcomputer 94.

In the microcomputer 94, the detection signal S92 is sampled every predetermined time and the sampled signals S92 are integrated to be converted to angle data representing the orientation of the head of the listener. A signal S94 of control data for actually locating (orientating) the acoustic image is generated on the basis of the angle data, and the signal S94 thus generated is supplied as a control signal to the digital processing circuit 5.

In this case, the circuit system extending from the processing circuit 5 to the amplifiers 7L, 7R and the circuit system extending from the detection means (rotational angular speed sensor) 91 to the microcomputer 94 are accommodated integrally in an unit such as a housing for accommodating acoustic units in a general headphone, and thus the headphone 80 is designed to have the same outlook of a general headphone.

Next, the processing of changing (converting) the number of channels by the digital processing circuit 3 will be described. In this case, the digital processing circuit 3 will be described on the assumption that it is constructed by a discrete circuit.

Figure 2:
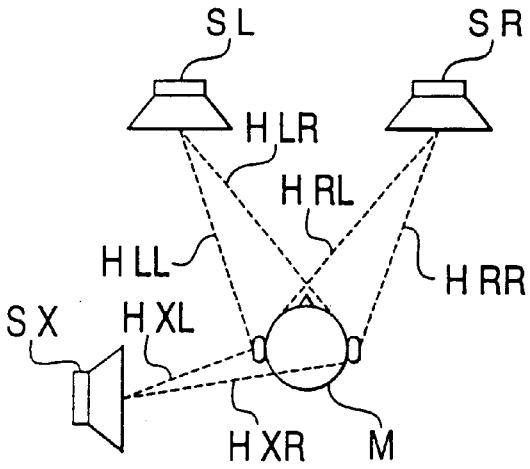
FIG. 2 is a plan view showing the present invention.

It is now considered that sound sources SL, SR are located at the left front and right front sides of a listener M, and a sound source SX is equivalently reproduced at any position out of the head by the sound sources SL, SR as shown in FIG. 2. Defining as follows:

HLL: transfer function going from the sound source SL to the left ear of the listener M, HLR: transfer function going from the sound source SL to the right ear of the listener M, HRL: transfer function going from the sound source SR to the left ear of the listener M, HRR: transfer function going from the sound source SR to the right ear of the listener M, HXL: transfer function going from the sound source SX to the left ear of the listener M, and HXR: transfer function going from the sound source SX to the right ear of the listener M, the sound sources SL, SR are represented as follows:

$$SL=(HXL\times HRR-HXR\times HRL)/(HLL\times HRR-HLR\times HRL)\times SX \quad (1)$$

$$SR=(HXR\times HLL-HXL\times HLR)/(HLL\times HRR-HLR\times HRL)\times SX \quad (2)$$

Accordingly, if the input audio signal SX corresponding to the sound source SX is supplied to a speaker located at the sound source SL through a filter for implementing the transfer function part of the equation (1), and the signal SX is supplied to a speaker located at the position of the source SR through a filter for implementing the transfer function part of the equation (2), the acoustic image based on the audio signal SX could be located at the position of the sound source SX.

Figure 3:
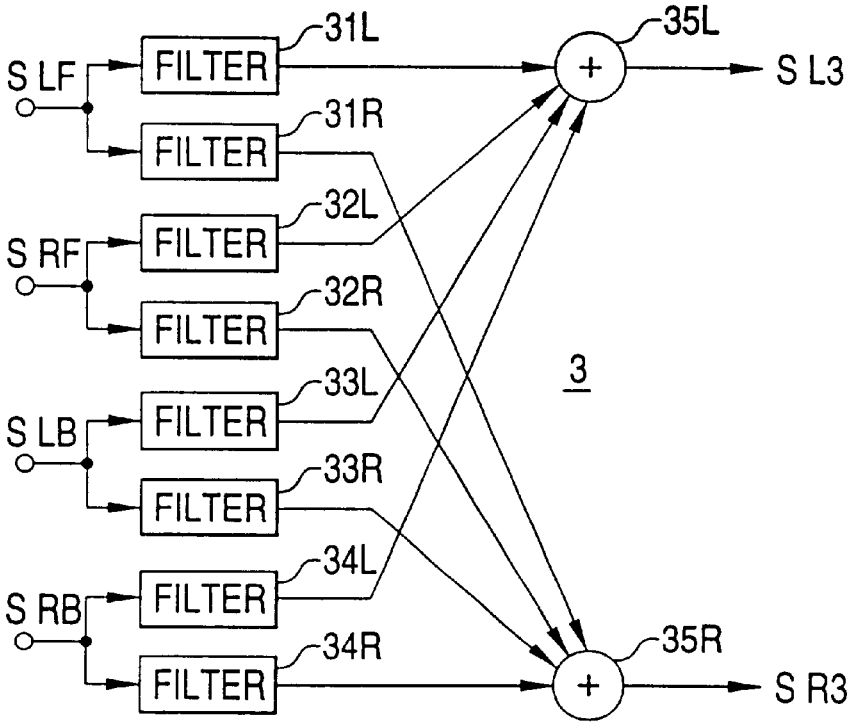
FIG. 3 is a systematic diagram showing an embodiment of a circuit usable in the present invention.

Therefore, for example, as shown in FIG. 3, the digital processing circuit 3 may be constructed by FIR type digital filters 31L to 34L, 31R to 34R and addition circuits 35L, 35R. That is, the audio signals SLF to SRB from the A/D converter circuits 21 to 24 are supplied to the addition circuit 35L through the digital filters 31L to 34L, and also supplied to the addition circuit 35R through the digital filters 31R to 34R.

At this time, the transfer functions of the digital filters 31L to 34L, 31R to 34R are set to predetermined values according to the above review, and impulse responses obtained by converting the same transfer functions as the transfer function parts of the equations (1) and (2) to the time axis are convoluted into the audio signals SLF to SRB.

Accordingly, from the addition circuits 35L, 35R can be output the audio signals SL3, SR3 with which the same reproduction sound field as achieved when 4-channel audio signals SLF to SRB are reproduced by four speakers can be reproduced by two speakers.

Next, the digital processing circuit 5 will be described on the assumption that it is constructed by a discrete circuit.

Figure 4:
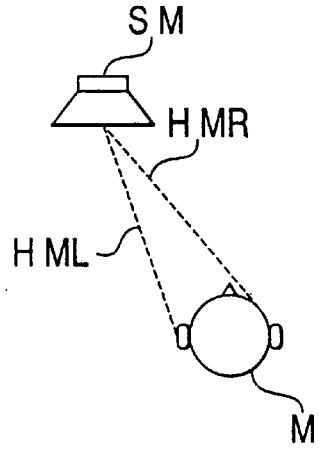
FIG. 4 is a plan view showing the present invention.

Now, when a sound source SM is located in front of a listener M as shown in FIG. 4, it is defined that:

HML: transfer function going from the sound source SM to the left ear of the listener M, and HMR: transfer function going from the sound source SM to the right ear of the listener M. In this case, the digital processing circuit 5 may implement the transfer functions HML, HMR.

Figure 5:
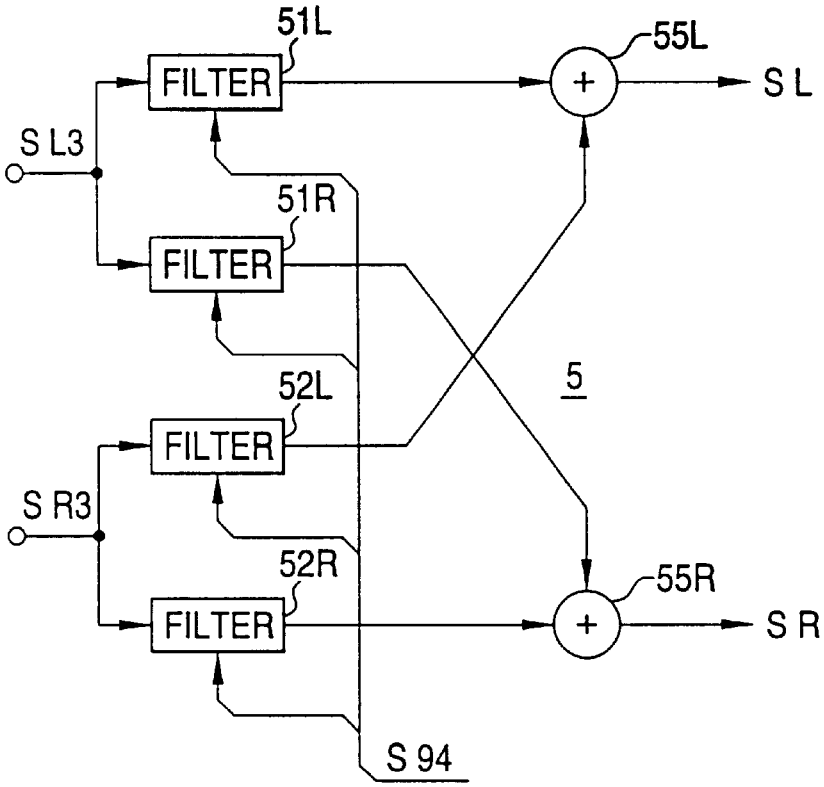
FIG. 5 is a systematic diagram showing an embodiment of the circuit usable in the present invention.

Therefore, the digital processing circuit 5 may be constructed by FIR type digital filters 51L, 52L, 51R, 52R and addition circuits 55L, 55R as shown in FIG. 5, for example.

That is, the audio signals SL3, SR3 from the digital processing circuit 3 are supplied to the addition circuit 55L through the digital filters 51L, 52L, and supplied to the addition circuit 55R through the digital filters 51R, 52R. Further, at this time, the transfer functions of the digital filters 51L to 52R are set to predetermined values, and impulse responses obtained by converting the transfer functions to the time axis are convoluted into the audio signals SL3, SR3.

Accordingly, the audio signal SL is output from the addition circuit 55L, and the audio signal SR is output from the addition circuit 55R. That is, the audio signals SL, SR with which the same reproduction sound field as achieved when the audio signals SL3, SR3 are reproduced by speakers can be reproduced by a headphone can be output from the addition circuits 55L, 55R.

As described above, the digital processing circuit 3 converts the 4-channel audio signals SLF to SRB to the 2-channel audio signals SL3, SR3 with which the same reproduction sound field as obtained when four speakers are used can be obtained by two speakers, and further the digital processing circuit 5 converts the signals SL3, SR3 to the audio signals SL, SR with which the same reproduction sound field as obtained when two speakers are used can be obtained with a headphone. Accordingly, when the audio signals SL, SR are supplied to the acoustic units 8L, 8R, the same reproduction sound field as obtained in the case of four-speaker reproduction system can be reproduced.

However, by using only the above construction, the location of the acoustic image reproduced by the acoustic units 8L, 8R is fixed with respect to the listener M. Therefore, when the listener M moves his/her head, the acoustic image is also moved together.

Therefore, as described above, the means 91 to 94 are further provided, and in the digital processing circuit 5, the transfer functions of the digital filters 51L to 52R are controlled by the signal S94 from the microcomputer 94. In this case, when a sound source is located in front of the listener M, the left ear is nearer to the sound source if the listener M turns to the right. Therefore, the time lag of sound wave incident to the left ear is adjusted to be reduced, and the level thereof is adjusted to be increased. Conversely, the time lag of sound wave incident to the right ear is adjusted to be increased and the level thereof is adjusted to be reduced. Therefore, the coefficients of the digital filters 51L to 52R are controlled by the signal S94 so that the above variation of the transfer functions is implemented.

Accordingly, when the listener M turns the head, the transfer functions in the digital processing circuit 5 are varied in accordance with the turning of the head, and the acoustic image formed by the acoustic units 8L, 8R is located at a fixed position out of the head irrespective of the turning of the head. For example, even when the listener turns the head while hearing music of an orchestra, the listener is kept in a natural state as if the orchestra is not moved and the listener turns the head before the orchestra. Alternatively, even when the listener turns the head while reproducing a DVD player, the locating position (fixed position) of the acoustic image can be made coincident with the position of the sound source in pictures.

As described above, according to the headphone adapter 10 and the headphone 80, the 4-channel reproduction sound field which are originally reproduced by four speakers can be reproduced by a headphone. In this case, if two headphones 80 are connected to the connectors 31, 32 of the adapter 10 respectively, two persons could enjoy sounds (pictures) simultaneously by the headphones. In this case, since the locating processing of the acoustic image in connection with the movement of the head of each person is performed independently in each of the headphones 80, the location of the acoustic image for one person is not effected by the movement of the head of the other person, and the same acoustic image location or the same reproduction sound field as achieved when only one person enjoy sounds can be obtained.

In addition, the headphone adapter 10 is common to the two headphones 80, and the overall price of the system can be reduced.

Further, the audio signals SL3, SR3 output to the connectors 31, 32 are signals obtained by converting the 4-channel audio signals SLF to SRB so that the 4-channel reproduction can be also performed by even two speakers. Therefore, when no headphone 80 is used, if the output signals SL3, SR3 of the connector 31 or 32 are supplied to two speakers through an amplifier, the 4-channel stereo reproduction can be performed by the two speakers.

Figure 6:
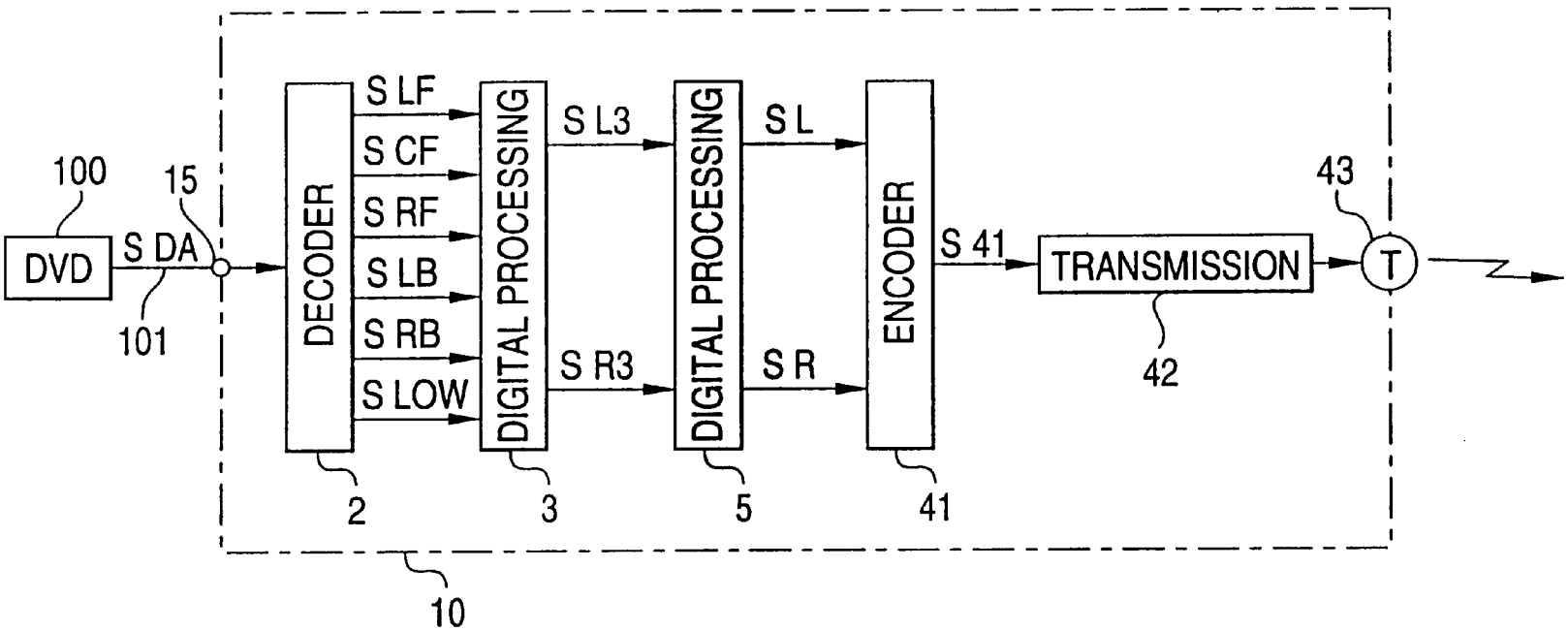
FIG. 6 is a systematic diagram showing a part of another embodiment of the present invention.
Figure 7:
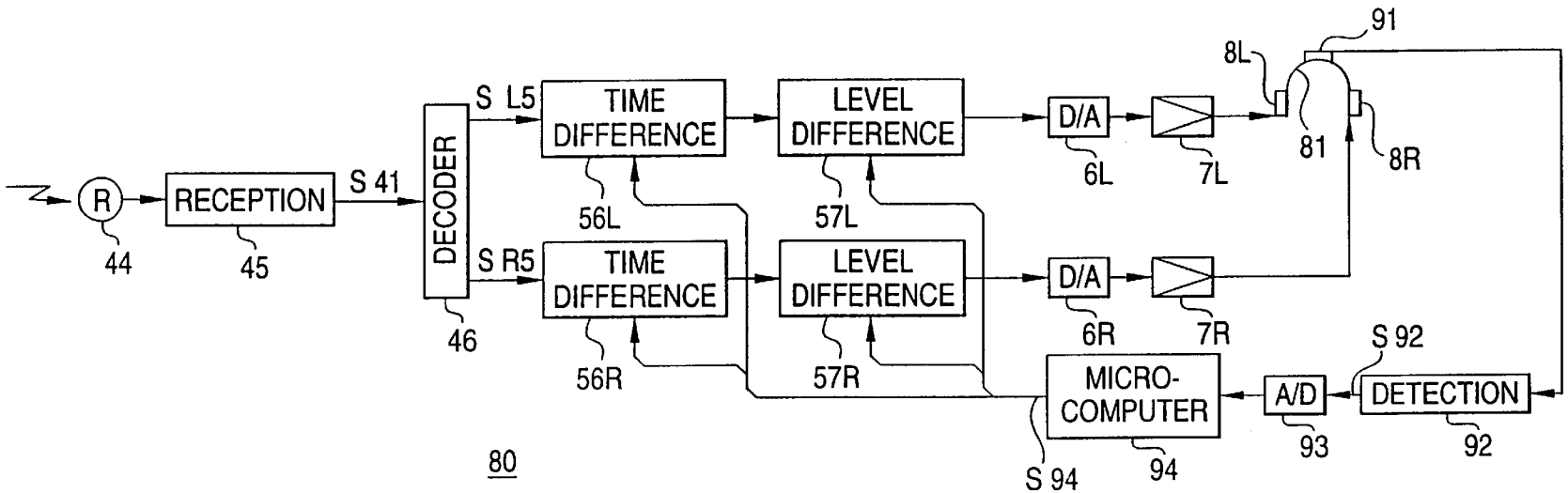
FIG. 7 is a systematic diagram showing a part of another embodiment of the present invention.

FIGS. 6 and 7 show a case where the headphone adapter 10 is designed to be connectable to a multi-channel audio signal source and particularly the transmission of the signals between the headphone adapter 10 and the headphone 80 is wirelessly performed.

That is, in FIG. 6, reference numeral 100 represents a digital audio signal source, and in this embodiment the signal source 100 is a DVD player. A so-called 5.1-channel digital audio signal SDA in Dolby digital (AC-3) is picked up from the DVD player 100.

The digital audio signal SDA is a signal obtained by encoding into one serial data (bit stream) 6-channel digital audio signals SLF, SCF, SRF, SLB, SRB, SLOW for left front, center front, right front, left rear and right rear and in a low frequency band below 120 Hz. In general, this signal SDA is supplied to a special-purpose adapter to be decoded and D/A-converted to original 6-channel audio signals SLF to SLOW, and the signals SLF to SLOW are supplied to the respective speakers to form a reproduction sound field.

Such a signal SDA is supplied from the player 100 to the input terminal 15 of the headphone adapter 10 through a coaxial cable 101, and further supplied to the decoder circuit 2 to be decoded to the audio signals SLF to SLOW, and these audio signals SLF to SLOW are supplied to the digital processing circuit 3.

Figure 8:
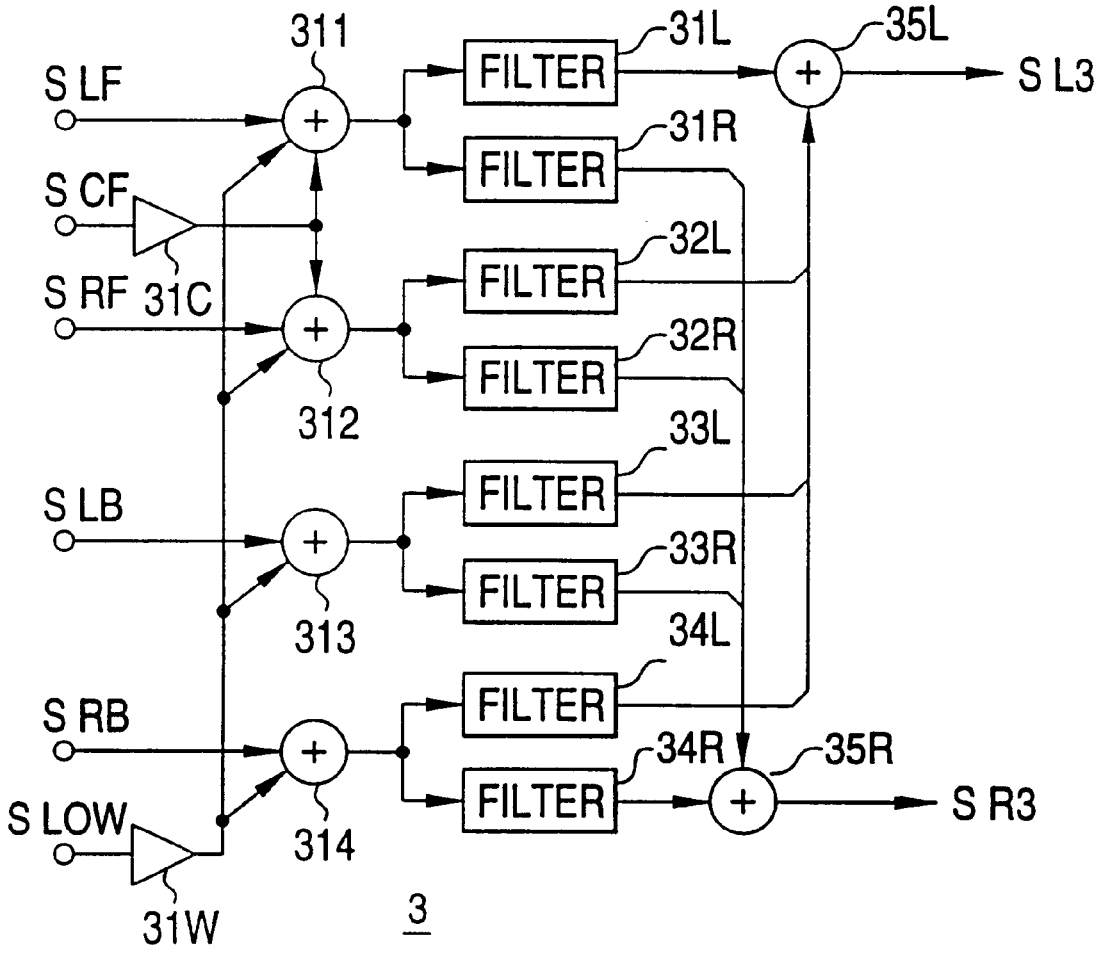
FIG. 8 is a systematic diagram showing an embodiment of the circuit usable in the present invention.

When the digital processing circuit 3 is constructed by a discrete circuit, it is constructed as shown in FIG. 8. That is, an acoustic image reproduced by supplying the audio signal SCF of the center front channel to the center front speaker can be reproduced by the left front and right front speakers. Further, the audio signal SLOW of a low-band channel has a low frequency, and thus generally the acoustic image formed by the signal SLOW accompanies no sense of direction.

Therefore, in the processing circuit 3 shown in FIG. 8, the digital audio signals SLF, SRF from the decoder circuit 2 are supplied to the digital filters 31L to 32R through addition circuits 311, 312, and also the digital audio signal SCF from the decoder circuit 2 is supplied to the addition circuits 311, 312 through an attenuating circuit 31C, whereby the audio signal SCF is distributed to the audio signals SLF, SRF.

Further, the digital audio signals SLB, SRB from the decoder circuit 2 are supplied to the digital filters 33L to 34R through the addition circuits 313, 314, and the digital audio signal SLOW from the decoder circuit 2 is supplied to the addition circuits 311 to 314 through an attenuation circuit 31W to distribute the audio signal SLOW to the audio signals SLF to SRB. The rear stage from the filters 31L to 34R is designed in the same construction as shown in FIG. 2.

As described above, in the processing circuit 3 the signals SLF to SLOW are converted to the 2-channel audio signals SL3, SR3 reproduced by two speakers with which the same reproduction sound field as that obtained when they are supplied to the speakers located at the left front side, the center front side, the right front side, the left rear side and the right rear side of a listener and speakers for low frequency band.

The audio signals SL3, SR3 are supplied to the digital processing circuit 5 to be converted to the audio signals SL, SR. That is, in the processing circuit 5, as described above, when the signals SL, SR are supplied to the headphone, the signals SL3, SR3 are converted to the signals SL, SR so as to implement the same reproduction sound field as obtained when the signals SL3, SR3 are supplied to the speakers located at the left front and right front sides of the listener.

In this case, the processing circuit 5 may be constructed as shown in FIG. 5. However, the coefficients of the digital filters 51L to 52R are fixed to values when the listener M faces the front side, and thus the acoustic image is fixed to the locating position when the listener M faces the front side.

The audio signals SL, SR from the processing circuit 5 are supplied to the encoder circuit 41 to be converted to 1-channel serial data signal S41. For example, it is converted to a digital audio interface signal S41 defined by EIAJ, which is used for the digital output of a CD player, etc. This signal S41 is supplied to a transmission circuit 42 to be converted to a transmission signal of a predetermined format, and this transmission signal is supplied to an infrared ray LED 43 to be converted to infrared rays, and then transmitted to the headphone 80.

At this time, in the headphone 80, the infrared rays from the LED 43 is received by a photosensor 44, and the output signal thereof is supplied to a reception circuit 45 to pick up the original signal S41. This signal S41 is supplied to the decoder circuit 46 to be separated into the original 2-channel audio signals SL5, SRS.

The signals SL5, SR5 thus separated are supplied to the D/A converter circuits 6L, 6R through additive circuits 56L, 56R having a time difference described later and additive circuits 57L, 57R having a level difference to be D/A-converted, and the audio signals after the D/A conversion are supplied to the right and left acoustic units 8L, 8R through the headphone amplifiers 7L, 7R.

Further, by the means 91 to 94, the facing direction of the head of the listener M is detected to form the signal S94, and the signal S94 is supplied as a control signal to the additive circuits 56L to 57R.

In this case, the circuits from the photosensor 44 to the amplifiers 7L, 7R and the circuits from the detection means 91 to the microcomputer 94 are accommodated integrally in a portion such as a housing for accommodating acoustic units in a general headphone, and thus the headphone 80 is designed to have the same outlook as a general headphone.

Accordingly, the digital processing circuit 3 converts the audio signals SLF to SRB to the audio signals SL3, SR3 with which the same reproduction sound field as obtained by six speakers can be obtained by two speakers, and the digital processing circuit 5 further converts these signals SL3, SR3 to the audio signals SL, SR with which the same reproduction sound field as obtained by two speakers can be obtained by a headphone. The signals SL, SR are supplied to the acoustic units 8L, 8R to reproduce the reproduction sound field as obtained by six speakers.

With only the above construction, the coefficients of the digital filters 31L to 34R in the processing circuit 5 are fixed, and thus the locating position of the acoustic image reproduced by the acoustic units 8L, 8R is fixed with respect to the listener M. Therefore, when the listener M moves the head, the acoustic image is moved together.

Therefore, the additive circuits 56L to 57R are provided as described above, and the time difference and the level difference added by the additive circuits 56L to 57R are controlled by the signal S94 from the microcomputer 94. That is, the additive circuit 56L, 56R is constructed by a variable delay circuit, and the additive circuit 57L, 57R is constructed by a variable gain circuit.

For example, when the sound source is located in front of the listener M, if the listener M turns to the right, the time delay of sound wave incident to the left ear is reduced, and the level thereof is increased. Therefore, the characteristic of the additive circuit 56L is controlled as indicated by a broken line B in FIG. 9, and the characteristic of the additive circuit 57L is controlled as indicated by a curved line C in FIG. 10. The left ear and the right ear are in the opposite position, so that the characteristic of the additive circuit 56R is controlled as indicated by a broken line A in FIG. 9 while the characteristic of the additive circuit 57R is controlled as indicated by a curved line D in FIG. 10.

Figure 9:
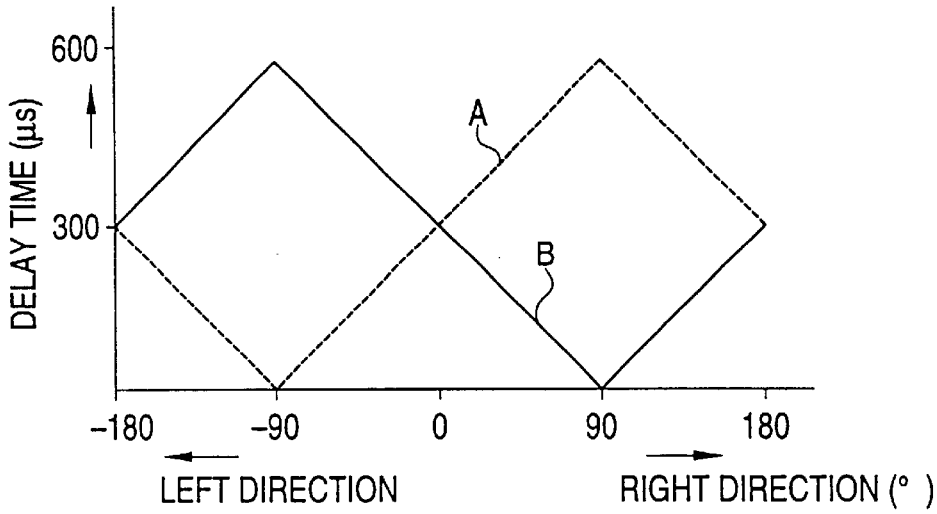
FIG. 9 is a characteristic diagram showing the present invention.
Figure 10:
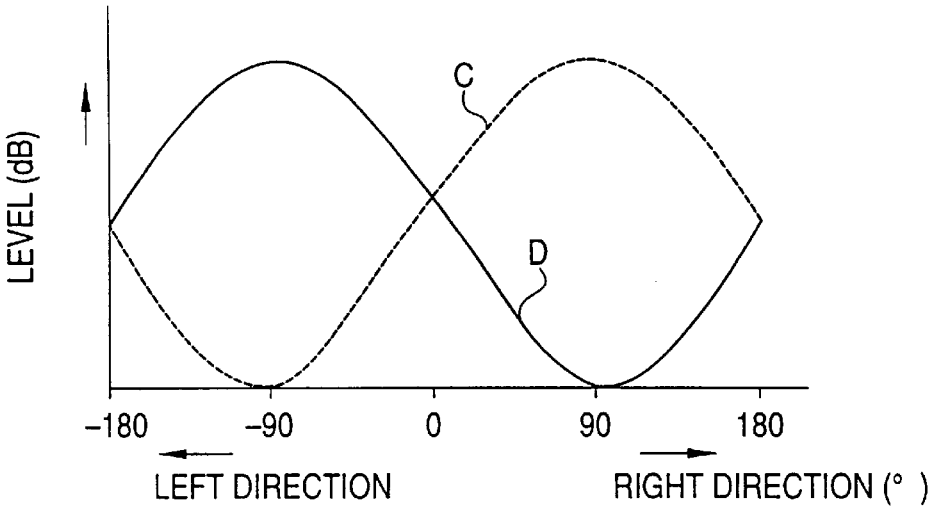
FIG. 10 is a characteristic diagram showing the present invention.

Accordingly, when the listener M turns the head, the time difference and the level difference of the signals SL, SR are varied in accordance with the turning direction as shown in FIGS. 9 and 10, so that the acoustic image formed by the acoustic units 8L, 8R is located at a fixed place in the outside irrespective of the turning of the head.

In this case, only one cable 101 is sufficient to the connection between the DVD player 100 and the headphone adapter 10, and thus the connection is simple. Further, the digital audio signal SDA reproduced by the DVD player 100 is not D/A-converted to an analog audio signal, but directly supplied to the headphone adapter 10 to implement the sound field reproduction. Therefore, deterioration of sound quality can be avoided.

Further, a wireless state is kept between the headphone adapter 10 and the headphone 80 with infrared rays, and thus a cumbersome work due to a cable connecting both the elements can be avoided. In addition, if headphones 80 whose number is equal to that of listeners are prepared, any persons can listen to DVD or the like simultaneously.

Further, when the coefficients of the digital filters 51L to 52R of the digital processing circuit 5 are renewed in accordance with the movement of the head, if the head is slightly moved, the coefficients of the digital filters 51L to 52R must be renewed every time, and thus a large number of high-speed sum-of-products operating circuits and memories are needed. However, in the headphone 80, the variation of the coefficients of the digital filters 51L to 52R with respect to the movement of the head portion is substituted or simulated by the change of the time difference and the level difference of the audio signals SL, SR, so that the circuit scale can be greatly simplified.

Further, when the acoustic image is fixed to the locating position by the signal S94 formed in accordance with the detection signal S92 of the movement of the head, it is unnecessary to supply the signal S94 from the headphone 80 to the headphone adapter 10 wirelessly, and thus the construction can be simplified.

Figure 11:
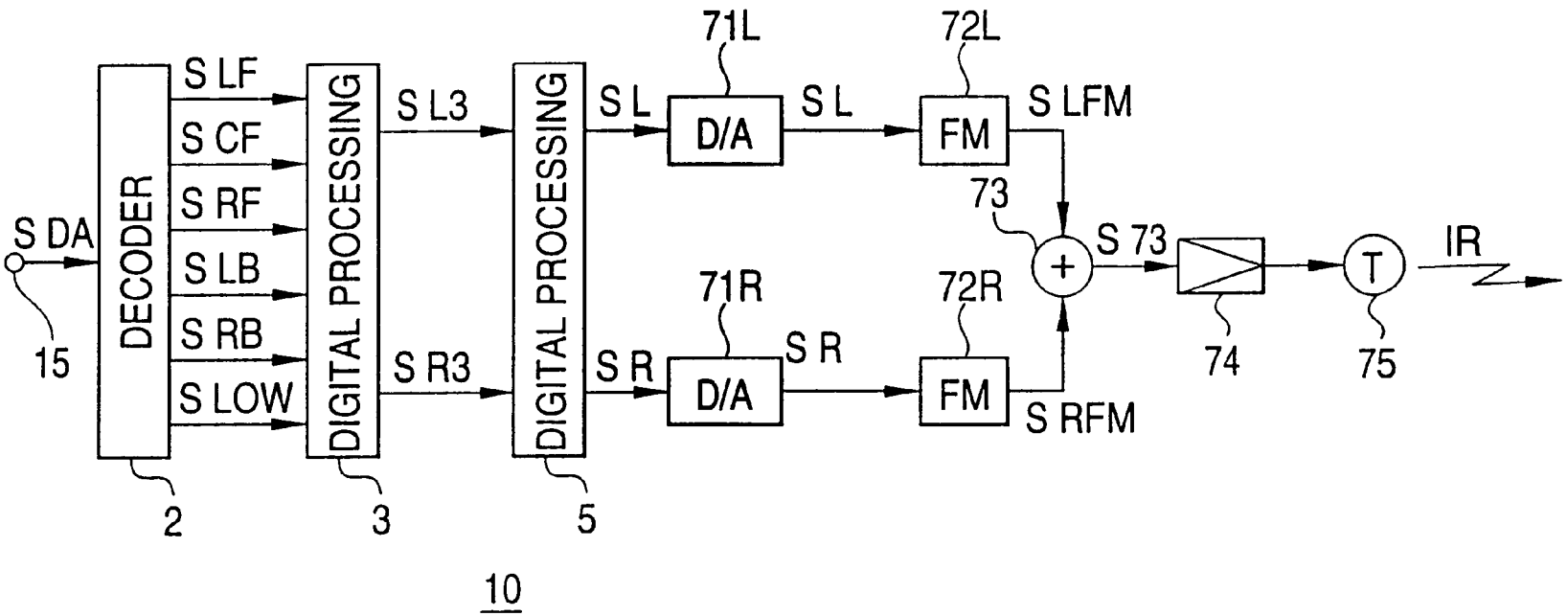
FIG. 11 is a systematic diagram showing another embodiment of the present invention.

FIG. 11 shows a case where the headphone adapter 10 is designed so that the same reproduction sound field as obtained by the speaker reproduction is obtained by using an existing infrared-ray type wireless headphone. That is, a signal line from the input terminal 15 to the digital processing circuit 5 is de signed in the same construction as the headphone adapter 10 of FIG. 6 to pick up the digital audio signals SL, SR from the digital processing circuit 5, and the audio signals SL, SR are supplied to D/A converter circuits 71L, 71R to be D/A-converted to analog audio signals SL, SR.

The audio signals SL, SR after the D/A conversion are supplied to FM modulation circuits 72L, 72R to be converted to FM signals SLFM, SRFM in this case, as an example, the FM signals SLFM, SRFM are set as follows:

Carrier frequency of FM signal SLFM: 2.3 MHz

Carrier frequency of FM signal SRFM: 2.8 MHz

Maximum frequency shift of signals SLFM, SRFM: ±150 KHz

The FM signals SLFM, SFMR are supplied to an addition circuit 73 to pickup an addition signal S73 of the signals SLFM, SRFM, and the signal S73 is supplied to an infrared-ray emitting element, for example, an infrared-ray LED 75 through a drive amplifier 74. Infrared radiation IR whose light amount is modulated in accordance with the signal S73 is output from the LED 75.

At this time, the audio signals SL, SR from the D/A converter circuits 71L, 71R are picked up to the output terminals 77L, 77R through amplifiers 76L, 76R.

Accordingly, if the infrared rays from the adapter 10 are received by the infrared ray type wireless headphone, the stereo reproduction sound could be obtained. In this case, a general infrared-ray type wireless headphone on the market may be used as the headphone.

Figure 12:
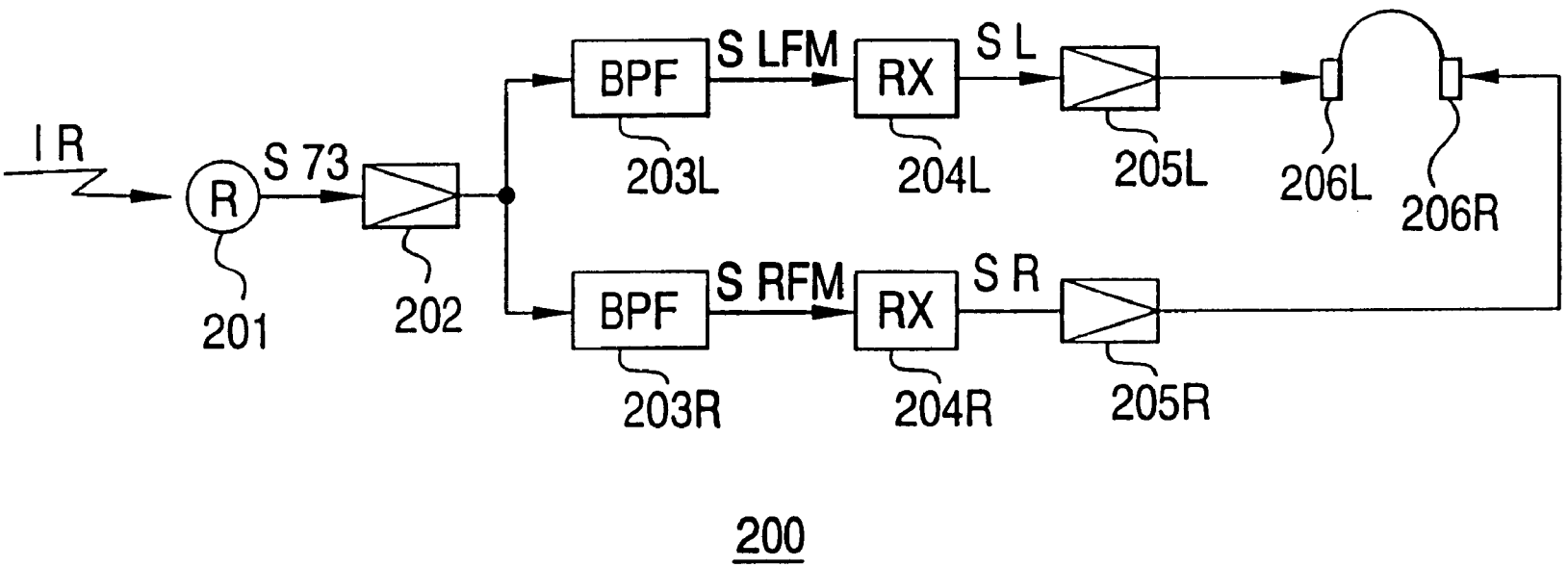
FIG. 12 is a systematic diagram showing the present invention.

That is, FIG. 12 shows an embodiment of the infrared-ray type wireless headphone 200 as described above. Infrared radiation IR from the headphone adapter 10 is photodetected by a photodetecting element such as a photodiode 201 to pick up the addition signal S73.

The output signal S73 of the photodetecting element 201 is supplied to π-shaped band pass filters 203L, 203R through an amplifier 202 to pick up the FM signals SLFM, SRFM from the addition signal S73. The signals SLFM, SRFM are supplied to FM reception circuits 204L, 204R. The reception circuit 204L, 204R directly uses general one chip IC for an FM receiver, and it has elements from a high-frequency amplifier to an FM demodulation circuit. Accordingly, in the reception circuit 204L, 204R, the FM signal SLFM, SRFM is frequency-converted to an intermediate frequency signal having a frequency of 10.7 MHz, and the intermediate frequency signal is subjected to FM demodulation to pick up the analog audio signals SL, SR.

The pickup audio signals SL, SR are supplied through drive amplifiers 205L, 205R to acoustic units 206L, 206R of the headphone 200.

Accordingly, according to the headphone adapter 10 of FIG. 11, the 6-channel stereo reproduction sound field as obtained in the case of the speaker reproduction can be implemented. In this case, the 6-channel stereo reproduction sound field can be implemented by using an infrared-ray type wireless headphone 200 on the market.

Further, a wireless state is established between the headphone adapter 10 and the headphone 200, and thus disturbance due to a cable connecting both the elements is avoided. In addition, if headphones whose number is equal to that of listeners are prepared, any persons can listen to music at the same time.

Figure 13:
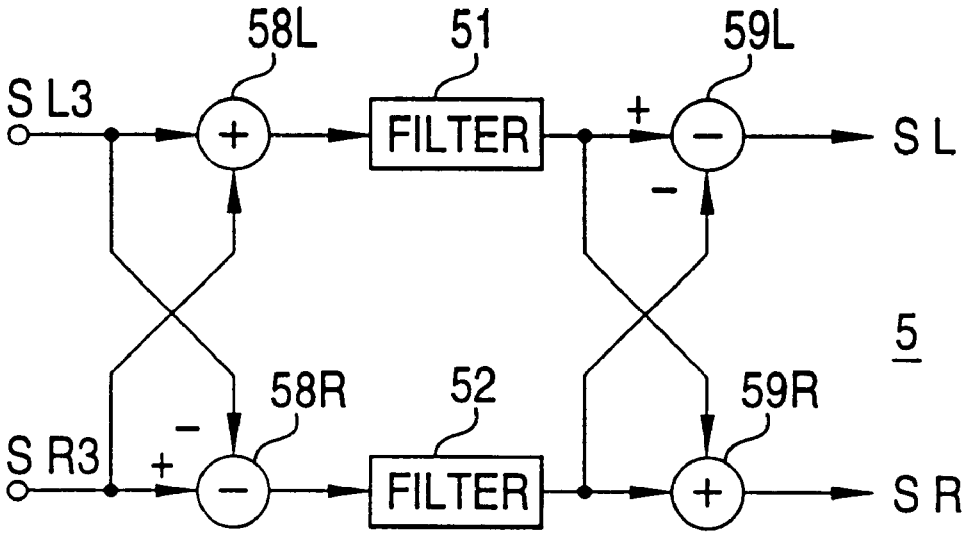
FIG. 13 is a systematic diagram showing an embodiment of the circuit usable in the present invention.

The digital processing circuit 5 may be constructed as shown in FIG. 13, for example. That is, the audio signals SL3, SR3 from the digital processing circuit 4 or the cable 4 are added in a predetermined rate in an addition circuit 58L, and then supplied to the digital filter 51. The audio signals SL3, SR3 are subtracted in a predetermined rate in a subtraction circuit 58R, and then supplied to the digital filter 52.

The respective output signals of the digital filters 51, 52 are subtracted in a predetermined rate in a subtraction circuit 59L to pick up the digital audio signal SL, and the respective output signals of the filters 51, 52 are added in a predetermined rate in an addition circuit 59R to pick up the digital audio signal SR.

According to the above manner, the processing amount of data as the digital processing circuit 5 can be reduced, and it is particularly effective when the digital processing circuit 5 is constructed by a DSP.

Further, in the headphone adapter 10 and the headphone 80 of FIG. 1, the signals SL3, SR3 can be transmitted from the headphone adapter 10 to the headphone 80 wirelessly as in the case of the headphone adapter 10 and the headphone 80 of FIGS. 6 and 7.

Further, in the headphone adapter 10 of FIGS. 6 and 11, the signal line between the terminal 15 and the decoder circuit 2 may be provided with a sampling rate converter circuit to convert the sampling rate of the digital audio signal SDA. Further, in FIG. 6, in place of the coaxial cable 101 and the terminal 15, an optical cable and a photodetecting element (TOS link) may be used.

Further, the rotational angle sensor 91 for detecting the facing direction of the head of the listener M may be constructed by a piezoelectric vibrating gyro or a geomagnetic azimuth sensor. Alternatively, it may be adopted that light emitting means is located in front of or around the listener M, and at least two light intensity sensors are provided to the headphone 80 to calculate the rotational angle of the head of the listener M on the basis of the output ratio of these light intensity sensors.

Further, burst-shaped ultrasonic wave output from an ultrasonic oscillator in front of or around the listener M may be detected by ultrasonic sensors located at two places which are remote from each other on the headphone 80 to be converted to a reception signal, and then the rotational angle of the headphone 80 may be calculated on the basis of the time difference of the reception signal.

According to the present invention, the same reproduction sound field as obtained when the multi-channel audio signals are supplied to the corresponding speakers, can be implemented by a headphone, and also even when the listener moves his or her head at that time, the locating position of the acoustic image can be fixed with respect to the outside.

Further, even if a plurality of listeners listen to music at the same time when the locating position of the acoustic image is fixed with respect to the outside, the locating position of the acoustic image is not affected by the movement of the head of another person, and the same acoustic image locating position or the same reproduction sound field as obtained when one listener enjoys listening can be obtained.

In addition, at that time, the headphone adapter is common to a plurality of headphones, so that the price of the overall system can be reduced. Further, as compared with the case where all the processing is collectively performed, the circuit can be designed in a smaller scale, and also the cost can be more reduced.

Only one cable is sufficient for the connection with a digital audio signal source such as a DVD player or the like, and thus the connection is simple. In addition, the digital audio signal from the signal source can be directly supplied, and deterioration of sound quality can be avoided.

In the above embodiments, the digital audio signal is supplied from a player such as a DVD player to the input terminal 15 of the headphone adapter 10 through a coaxial cable, and further supplied to the decoder circuit 2 to be decoded to the audio signals SLF to SLOW. However, these audio signals may be transmitted from the player under a wireless condition by using infrared rays, and the decoder circuit may be designed to receive the audio signals transmitted under the wireless condition.

Further, when signal transmission between the headphone adapter and the headphone is performed wirelessly, disturbance due to a cable connecting both the elements is avoided, and if headphones whose number is equal to the number of listeners are prepared, any number of persons can listen to DVD or the like.

In the above-described headphone, when the variation of the coefficients of the digital filters with respect to the movement of the head portion is substituted or simulated by the change of the time difference and the level difference of the audio signals, the circuit scale can be greatly simplified. Further, when the locating position of the acoustic image is fixed by the signal formed in accordance with the detection signal of the movement of the head, it is unnecessary to supply the signal from the headphone to the headphone adapter, and thus the construction can be simplified.

What is claimed is:

1. A sound reproducing device comprising:

an earphone device;

a first signal processing device including a first signal processing circuit receiving an input audio signal of four channels and for converting the input audio signal to a first 2-channel audio signal with which a reproduced acoustic image is located at a predetermined position relative to a listener when the first 2-channel audio signal is connected to a first output terminal and reproduced by a 2-channel speaker system a second signal processing circuit receiving the first 2-channel audio signal and for subjecting the first 2-channel audio signal to signal processing equivalent to transfer functions of a 2-channel speaker system to both ears of a listener listening to the 2-channel speaker system, thereby converting the first 2-channel audio signal into a second 2-channel audio signal connected to a second output terminal, said second processing device processing the first 2-channel audio signal so that when the second 2-channel audio signal is reproduced over said earphone device connected to said second output terminal a reproduced acoustic image is located outside the head of a listener wearing the earphone device; and said earphone device including a pair of electroacoustic transducing means receiving the second 2-channel audio signal from said second signal processing circuit and including detection means for detecting a movement of the head of the listener wearing the earphone device, wherein said second signal processing circuit performs processing corresponding to an alteration of the transfer functions in accordance with the output of said detection means to control the location of the acoustic image perceived by the listener using the earphone device.

2. The sound reproducing device as claimed in claim 1, wherein said earphone device includes means for integrally forming said second signal processing circuit, said pair of electro-acoustic transducing means, and said detection means therein.

3. The sound reproducing device as claimed in claim 1, wherein said signal processing device includes a plurality of output terminals the output signal of said first signal processing circuit is output at said plurality of output terminals, and a plurality of earphone devices are connected to said plurality of output terminals.

4. The sound reproducing device as claimed in claim 1, wherein said detection means comprises a piezoelectric vibrational gyro.

5. A sound reproducing device comprising:

a signal processing device including a first signal processing circuit receiving an input audio signal of at least one channel and for converting the input audio signal to a first 2-channel audio signal with which an acoustic image is located at a predetermined position when the first 2-channel audio signal is reproduced by a 2-channel speaker system and a second signal processing circuit receiving the first 2-channel audio signal and for subjecting the first 2-channel audio signal to signal processing equivalent to transfer functions of said 2-channel speaker system to both ears of a listener, thereby converting the first 2-channel audio signal into a second 2-channel audio signal; and an earphone device including a third signal processing circuit receiving the second 2-channel audio signals from said second signal processing circuit, a pair of electro-acoustic transducing means receiving an output signal from said third signal processing circuit, and detection means for detecting movement of the listener's head, wherein said third signal processing circuit performs processing corresponding to an alteration of the transfer functions in accordance with an output of said detection means for controlling the position of the acoustic image perceived by the listener.

6. The sound reproducing device as claimed in claim 5, wherein said earphone device includes means for integrally forming said third signal processing circuit, said pair of electro-acoustic transducing means, and said detection means therein.

7. The sound reproducing device as claimed in claim 5, wherein said signal processing device includes a plurality of output terminals, the output signal of said second signal processing circuit is output at said plurality of output terminals, and a plurality of earphone devices are connected to said plurality of output terminals.

8. The sound reproducing device as claimed in claim 5, wherein said detection means comprises a piezoelectric vibrational gyro.

9. An earphone device used in combination with a signal processing device supplied with an input audio signal of four channels and for converting the input audio signal to a first 2-channel audio signal with which a reproduced acoustic image is located at a predetermined position relative to a listener when the first 2-channel audio signal is reproduced by a 2-channel speaker system and for subjecting the first 2-channel audio signal to signal processing equivalent to transfer functions of said 2-channel speaker system to both ears of a listener listening to the 2-channel speaker system, the earphone device comprising:

a signal processing circuit receiving the first 2-channel audio signal from said signal processing device for subjecting the first 2-channel to signal processing equivalent to transfer functions of a 2-channel speaker system to both ears of a listener listening to the 2-channel speaker system, thereby converting the first 2-channel audio signal into a second 2-channel audio signal;

a pair of headphones supplied with said second 2-channel audio signal output from said signal processing circuit, wherein said signal processing circuit processes said first 2-channel audio signal so that when the second 2-channel audio signal is reproduced over said pair of headphones a reproduced acoustic image is located outside the head of a listener wearing the pair of headphones; and detection means for detecting movement of the head of the listener wearing said pair of headphones, wherein said signal processing circuit performs processing corresponding to an alteration of the transfer functions on the second 2-channel audio signal in accordance with an output of said detection means for controlling the position of the acoustic image perceived by the listener wearing the pair of headphones.

10. The earphone device as claimed in claim 9, wherein said detection means comprises a piezoelectric vibrational gyro.

* * * * *